US007552926B2

(12) United States Patent
Van Soest

(10) Patent No.: US 7,552,926 B2
(45) Date of Patent: Jun. 30, 2009

(54) SHEET TRANSPORTATION DEVICE AND PRINTER COMPRISING A DEVICE OF THIS KIND

(75) Inventor: Gerardus J. C. Van Soest, Bergen (NL)

(73) Assignee: OCE Technologies B.V., Venlo (NL)

( * ) Notice: Subject to any disclaimer, the term of this patent is extended or adjusted under 35 U.S.C. 154(b) by 168 days.

(21) Appl. No.: 11/636,595

(22) Filed: Dec. 11, 2006

(65) Prior Publication Data

US 2007/0138739 A1 Jun. 21, 2007

(30) Foreign Application Priority Data

Dec. 20, 2005 (NL) ..... 1030709

(51) Int. Cl.
*B65H 5/06* (2006.01)

(52) U.S. Cl. ..... 271/273; 271/272; 271/274; 271/184

(58) Field of Classification Search ..... 271/272, 271/273, 274, 314, 184, 188
See application file for complete search history.

(56) References Cited

U.S. PATENT DOCUMENTS 2,852,255 A * 9/1958 Fischer ..... 271/94
4,621,802 A * 11/1986 Ishida et al. ..... 271/272
4,645,195 A 2/1987 Scranton et al.
5,244,191 A * 9/1993 Kanekura ..... 271/10.11
5,383,655 A * 1/1995 Hayakawa et al. ..... 271/10.01
6,139,006 A 10/2000 Asada

FOREIGN PATENT DOCUMENTS

JP 60023239 5/1985
JP 2004287284 10/2004

* cited by examiner

*Primary Examiner*—Patrick H Mackey
*Assistant Examiner*—Ernesto Suarez
(74) *Attorney, Agent, or Firm*—Birch, Stewart, Kolasch & Birch, LLP

(57) ABSTRACT

A sheet transportation device includes a transportation roller driven during operation, a guiding element and an actuation device that is used to switchably affect the interspacing between the transportation roller and the guiding element. In a closed state during operation, a sheet is guided against the driven roller by the guiding element. The sheet transportation device also includes a freely rotatably arranged roller that is positioned in the vicinity of and arranged concentrically relative to the transportation roller. The freely rotatably arranged roller extends in a radial direction beyond a circumferential edge of the transportation roller. A reversing station and a printer can also include a sheet transportation device of this kind.

16 Claims, 3 Drawing Sheets

SHEET TRANSPORTATION DEVICE AND PRINTER COMPRISING A DEVICE OF THIS KIND

CROSS-REFERENCE TO RELATED APPLICATIONS

This nonprovisional application claims priority under 35 U.S.C. § 119(a) on Dutch Patent Application No. 1030709, filed in The Netherlands on Dec. 20, 2005, the entirety of which is incorporated herein by reference.

BACKGROUND OF THE INVENTION

1. Field of the Invention

The present invention relates to a sheet transportation device. In particular, the present invention relates to a sheet transportation device that includes a transportation roller that is driven during operation, a guiding element and an actuation mechanism that is used to switchably affect the interspacing between the transportation roller and the guiding element. In a closed state during operation, a sheet is guided against the driven roller by the guiding element. The present invention also relates to a reversing station and a printer that include the sheet transportation device of the present invention.

2. Description of Background Art

A device of this kind is known from U.S. Pat. No. 4,645,195, in which a transportation clamping arrangement may adopt an active and a passive state. In the active state, a sheet is conveyed towards a driven transportation roller. In the active state, the two rollers of the clamping arrangement are closed, enabling a sheet to be transported by means of a friction force from the driven transportation roller.

A disadvantage of this known device is that a sheet cannot be conveyed, in a controlled manner, in a direction opposed to the driven roller's direction of transportation.

SUMMARY OF THE INVENTION

An object of the present invention is to obtain a sheet transportation device, where sheets may be conveyed in a direction opposed to the driven roller's direction of transportation. To this end, an embodiment of the present invention is directed to a sheet transportation device comprising: a transportation roller, said transportation roller being driven during operation; a freely rotatably arranged roller being positioned in the vicinity of and arranged concentrically relative to the transportation roller, said freely rotatably arranged roller extending in a radial direction beyond a circumferential edge of the transportation roller; a guiding element; and an actuation mechanism, said actuation mechanism switchably affecting an interspacing between the transportation roller and the guiding element, wherein, in a closed state during operation, a sheet is guided against the transportation roller by the guiding element.

In the device according to the present invention, a sheet may be conveyed, in a controlled manner, in a direction opposed to the driven roller's direction of transportation, since a sheet that is conveyed in such opposing direction is guided between the freely rotatably arranged roller and a guiding element. By creating an opening between the guiding element and the driven roller, a sheet is not guided against the driven roller, but may be conveyed, in a controlled manner, in the opposing direction.

A device according to the present invention may be used in any application in which a sheet must be conveyed in the direction of transportation or, in a controlled manner, in an opposing direction, as desired. The device according to the present invention may be used particularly conveniently in a reversing station, where a sheet, depending on the subsequent treatment, must be returned, either in a reversed orientation or not, to a continuation process or back into the printing process for printing a second side.

In one embodiment according to the present invention, the transportation roller is enclosed, in the axial direction, by the freely rotatably arranged roller and a second freely rotatably arranged roller, both of the freely rotatably arranged rollers being positioned in the vicinity of the driven roller and extending in the radial direction beyond the circumferential edge of the driven roller.

This embodiment is convenient, since with the clamping arrangement in an open state, a sheet is supported by the freely rotatably arranged rollers at either side of the driven roller, enabling a sheet to be kept away from the driven roller in order to prevent the sheet from experiencing a friction force from this roller. As such, the sheet may be conveyed, in a controlled manner, in the opposing direction.

According to an alternative embodiment of the present invention, the driven shaft has been multi-embodied with a plurality of driven rollers surrounded by freely rotatably arranged rollers.

In one embodiment according to the present invention, the guiding element includes a freely rotatably arranged roller, and a rotation shaft of the freely rotatably arranged roller of the guiding element extends in a direction parallel to a rotation shaft of the transportation roller.

This embodiment is convenient, since in this way, the guiding element is able to guide a sheet in both the direction of transportation and the opposing direction, without a sheet experiencing excessive friction from the guiding element. Furthermore, a guiding element embodied as a freely rotatably arranged roller is technically easy to achieve. A guiding element of this kind may be embodied either as one piece or as separately moving small components.

In one embodiment according to the present invention, the guiding element extends as far as the transportation roller in an axial direction.

This embodiment is convenient since dimensioning ensures that the sheet may be guided properly against the driven roller in the closed state, whereas the freely rotatably arranged roller situated near the driven roller does not prevent the guiding element from moving towards the driven roller.

In one embodiment according to the present invention, the actuation mechanism affects the relative position of the guiding element relative to the transportation roller, and, in operation, in an open state, a sheet can be guided past the freely rotatably arranged roller in a direction opposed to a direction of transportation of the transportation roller.

This embodiment is convenient since in this manner, a sheet may be reliably sent in the direction of transportation during the closed state, whereas in the open state, guidance is still provided to a sheet that is conveyed in opposing direction, on the one hand by the guiding element and on the other hand by the freely rotatably arranged roller. In the open state, the distance between the guiding element and the freely rotatably arranged roller has been chosen such that it is large enough to be able to feed through the entire range of sheet types, yet small enough to ensure that a sheet is not conveyed through the space without any guidance.

In one embodiment according to the present invention, the transportation roller comprises a material at a circumferential edge thereof that has a high friction force.

This embodiment is convenient since in this way, a transportation force is efficiently transferred from the transportation roller onto the sheet in the closed state.

In a further embodiment according to the present invention, the material at the circumferential edge of the transportation roller comprises a rubber.

This embodiment is convenient, since the friction and transportation characteristics of the transportation roller may be monitored properly. By the choice of rubber, a good transportation force is transferred onto the sheet, without affecting the sheet or the image on the sheet.

A sheet transportation device according to the present invention may be used particularly conveniently in a reversing station for reversing the sheet orientation, since a reversing station needs to convey a sheet either in a reversed orientation or not, depending on the desired end result, whereas it must also be possible to convey a sheet in the opposing direction.

A sheet transportation device according to the present invention may be used particularly conveniently in a printer or any other type of document processing device. The feasibility of conveying a sheet through the clamping arrangement in two directions enables the technical complexity of the motors to be reduced, since the transportation roller does not need to stop or change rotation direction to convey a sheet in the opposing direction.

According to an alternative embodiment of the present invention, a plurality of driveshafts of various transportation clamping arrangements are connected to one single motor. By opening or closing the sheet transportation device according to the present invention, the central motor will not, or not as frequently, be required to stop or change rotation direction for a sheet to sustain a desired course.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
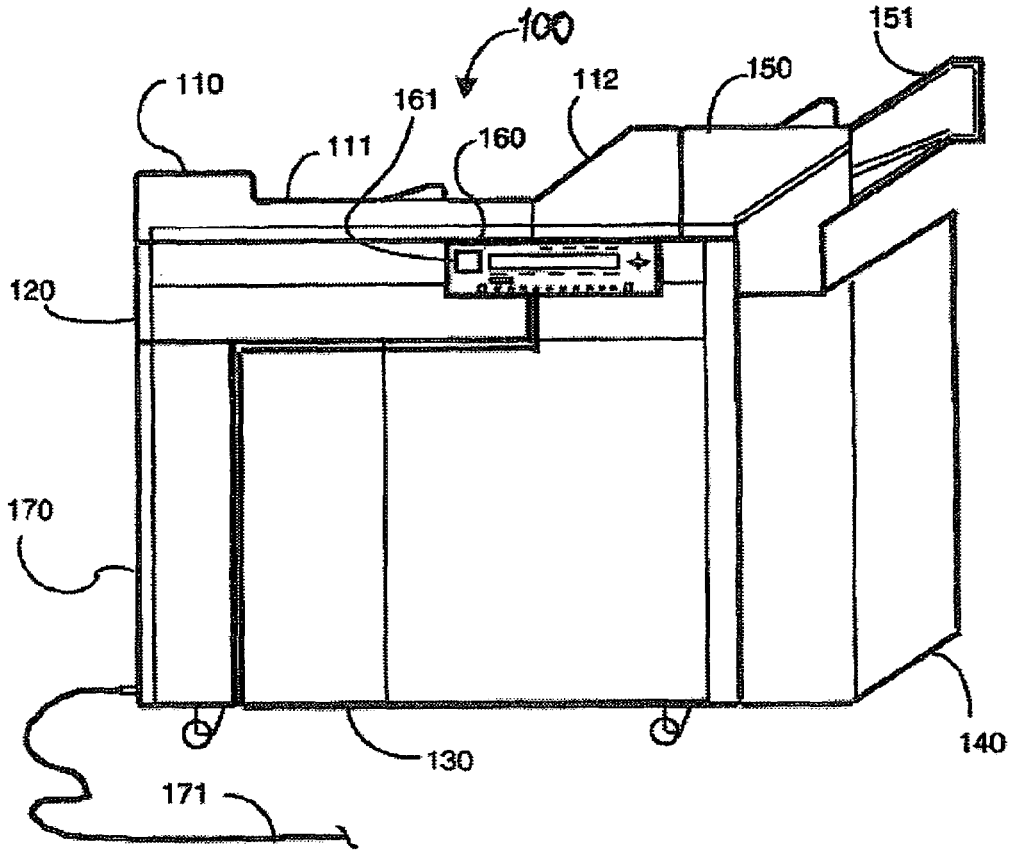
FIG. 1 is a diagram showing a printing device including a sheet transportation device according to an embodiment of the present invention.

FIG. 1 shows a device 100 used for processing documents. These documents are usually paper documents, but may also comprise other types of media, such as transparencies, books, drawings, etc.

The device 100 includes a printing unit including an electro-photographic processing component 130. A photo-conducting medium is uploaded in the electro-photographic processing component 130 in a manner generally known, imagewise exposed by means of an LED unit for example, in order to correspond to a digital image that is subsequently developed using toner powder. The toner image is then transferred and fixed onto a medium such as a sheet of paper. The sheets are supplied via a storage component 140, which may be located inside or outside the device 100. The printed sheets are fed from the printing unit to a post-processing station 150, where the sheets are collated, stapled, folded, etc. depending on the desired end result. The sheets are then conveyed to an output station 151 enabling a user to remove the document or set of documents.

The document-processing device may include only a printer. However, it is preferred that the document processing device be a multi-functional device that, in addition to a printing unit, also includes scanning, copying and fax transmission functionalities, for example. A user may enter their task options using a user interface 160 and start the task using a start button 161. If applicable, a multi-functional device of this kind can include a document input station 110 where a stack of documents may be fed into the device via an input table 111. Here, the documents are conveyed along a scanning unit 120 and output onto an output station 112. The scanning unit 120 converts an optically recorded image, using a CCD, into a digital image that may subsequently be sent to the printing unit via a memory.

A control unit 170 that includes a processor and is connected to a local network 171 via a local network unit may control the entire multi-functional workflow. The local network 171 may be of a hard-wired or a wireless design.

Figure 2:
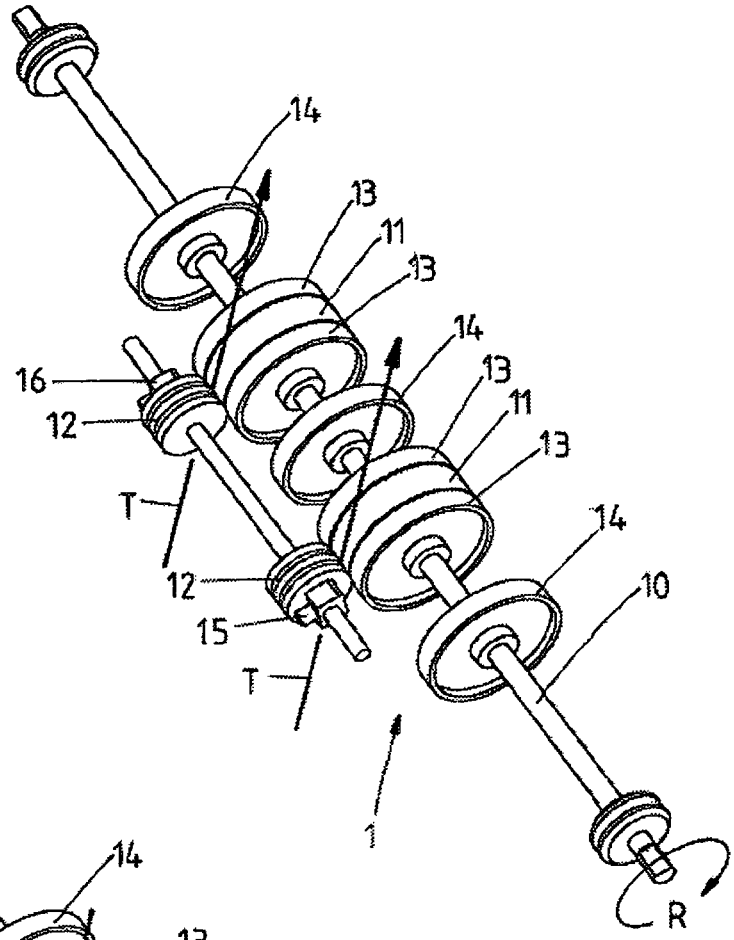
FIG. 2 is a diagram showing a perspective view of a sheet transportation device according to an embodiment of the present invention shown in closed state.

FIG. 2 shows a sheet transportation device according to an embodiment of the present invention shown in a closed state. A transportation roller 11 has been fitted onto a driven shaft 10, such that the transportation roller 11 is also driven by the drive action of the driven shaft 10 in a direction indicated by arrow R. A guiding element 12 is located at the level of transportation roller 11. The guiding element 12 is embodied here as a freely rotatably arranged roller. The rotation shaft of this guiding element 12 extends in a direction parallel to the rotation shaft of transportation roller 11. If, in the driven state, a sheet is fed between the transportation roller 11 and the guiding element 12, the sheet will experience a force in a direction of transportation T via the surface of the transportation roller 11. In this way, a sheet is conveyed through the paper path in which the device has been fitted. A roller 13 is located in the vicinity of transportation roller 11. The roller 13 is arranged concentrically relative to the transportation roller and is arranged freely rotatably on the shaft 10. The roller 13 extends, in a radial direction, beyond the circumferential edge of the transportation roller 11. In the device's closed state as shown, the guiding element 12 pushes an input sheet against the transportation roller 11, causing the sheet to experience a force in the direction of transportation T. Since the guiding element 12 substantially extends in the axial direction equally as far as the transportation roller 11, a sheet will bend slightly around the circumferential edge of the roller 13.

Figure 3:
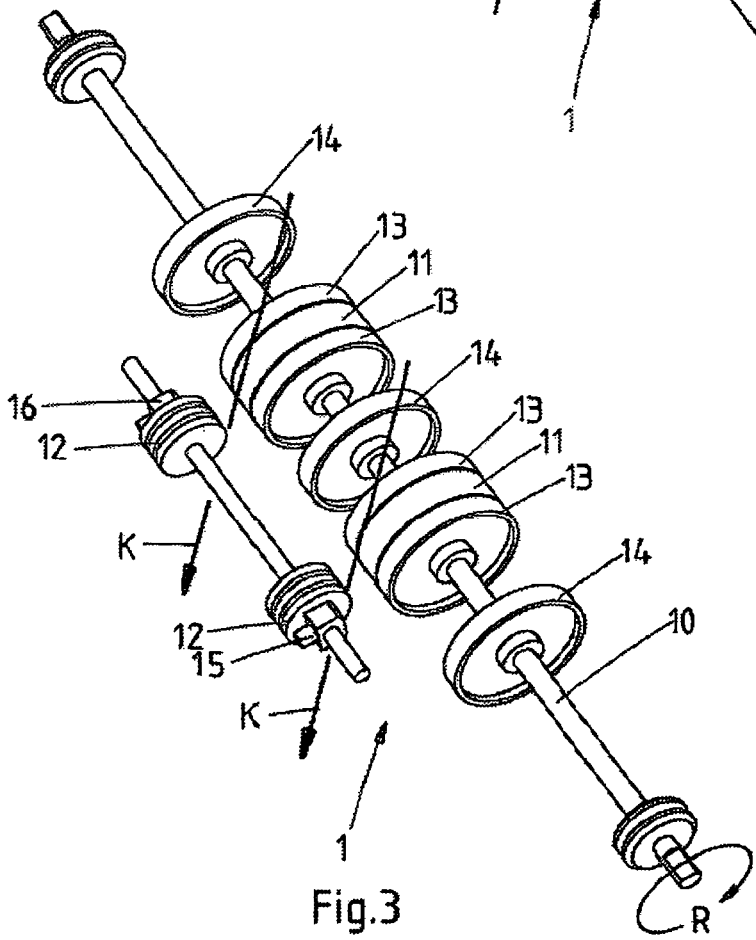
FIG. 3 is a diagram showing a perspective view of a sheet transportation device according to an embodiment of the present invention shown in open state.

In FIG. 3, the sheet transportation device according to an embodiment of the present invention is shown in the open state. Using an actuation mechanism 15, 16, the relative position of the guiding element 12 and the transportation roller 11 may be switchably varied. If applicable, it is convenient for a sheet to be conveyed through the paper path in a direction opposed to the direction of transportation T. By slightly increasing the distance between guiding element 12 and transportation roller 11, a sheet conveyed into the paper path in an opposing direction K may be reliably conveyed through the transportation device. The movement of the sheet will then be restricted by guiding element 12 and freely rotatably arranged roller 13, enabling the sheet to pass in a reliable manner. During this movement of a sheet in the opposing direction K, the transportation roller 11 may remain driven, preventing the need for any technically complex measures to be taken for the transportation roller to brake in time and to subsequently regain speed promptly. This is possible because a sheet is not brought into contact with transportation roller 13.

In order to arrange for the movement of a sheet to occur reliably through the sheet transportation device, a plurality of transportation rollers 11 have been fitted at some distance from each other spread across the width of shaft 10. The transportation rollers 11 are surrounded on either side by freely rotatably arranged rollers 13. By actually positioning these rollers 13 symmetrically in the vicinity of transportation roller 11, it is ensured that the sheets are safely kept away. As such, sheets of a low paper density, e.g. of 50 g/m2, which usually have little rigidity in directions away from the surface, may equally be fed through reliably in opposing direction K, without coming into contact with transportation roller 11, which would cause a force in direction of transportation T to be transferred onto the sheet by driven roller 11.

The difference in diameter between the transportation roller 11 and the freely rotatably arranged roller 13 has been chosen such that a sheet may be kept far enough away from transportation roller 11 when in the open state. In the closed state, where a sheet that is guided against transportation roller 11 by guiding element 12 in accordance with the description above, the difference in diameter has been chosen to prevent the sheet from being damaged by excessive bending. Tests have shown that a 1 mm difference in diameter between the freely rotatably arranged roller 13 and transportation roller 11 yields good results for the entire range of common media types. However, one having ordinary skill in the art will recognize that other differences in diameter is within the scope of the present invention.

The guiding element 12 must be chosen such that sheets may be guided easily in both directions. In embodiments where a statically arranged guiding element is used, the surface of the guiding element is chosen such that it is smooth enough not to damage sheets when being guided against transportation roller 11 or being guided in opposing direction K. In embodiments where a freely rotatably arranged roller acts as the guiding element 12, as is the case in the embodiments shown in FIGS. 2 and 3, the rotation shaft of the guiding elements 12 is positioned parallel to the rotation shaft of the transportation roller 11. In this way, when a sheet is being moved in both directions T and K, any undesirable friction in any direction other than the directions T or K does not negatively affect a sheet.

In order to convey a sheet through the paper path as efficiently as possible, the transportation roller 11 has been provided with a layer of rubber at its circumferential edge, such that the force in the direction of transportation is efficiently transferred from the driven roller 11 onto the sheet. This material has been chosen such that the friction force between the sheet and the roller 11 is large enough, without the transportation roller 11 causing any distortions or blemishes to the image.

An example of an application where a transportation device has been used conveniently, where a sheet must also be able to pass through in an opposing direction, is a reversing clamping arrangement in a printer. If applicable, it is convenient for a sheet to be turned over inside a printer, for example in order for the other side of the sheet to be printed or to obtain the desired output orientation.

Figure 4:
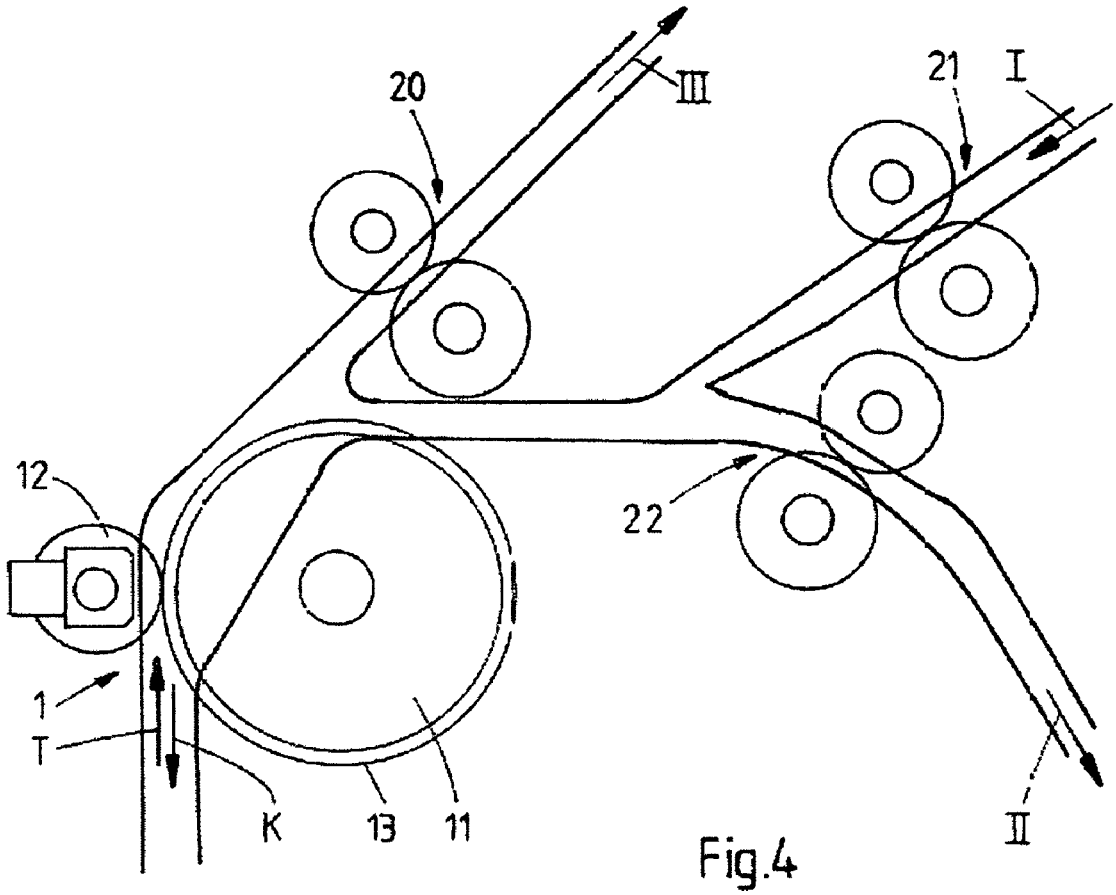
FIG. 4 is a diagram showing a reversing station including a sheet transportation device according to an embodiment of the present invention.

FIG. 4 shows an example of an application where a reversing clamping arrangement uses a transportation device according to an embodiment of the present invention. Here, a plurality of transportation clamping arrangements 20, 21, 22 push a sheet along in a desired direction of transportation in a manner generally known. A sheet enters the device from a process where an image is produced in a manner generally known, from the direction indicated by arrow I. Depending on the desired subsequent path, a sheet is sent to an output position or post-processing station (arrow III) or, after reversing, back into the printing process for a second side of the sheet to be printed (arrow II). All the transportation clamping arrangements shown may be controlled individually, but for the purposes of decreasing the technical complexity, it has been chosen here to control all transportation clamping arrangements 20, 21, 22 as well as sheet transportation device 1 using one single drive action. By connecting an electric motor in series with all transportation clamping arrangements 20, 21, 22, 1 using a power transmission, such as a belt (not shown), a sheet is pushed along in any desirable direction using a technically simple construction.

The embodiment of sheet transportation clamping arrangement 1 according to the present invention allows extra freedom in timing and drive action. This is because an electric motor that must be able to brake instantaneously and move in opposing direction, places high demands on the capacity and other specifications of such a motor. Since guiding element 12 may be easily switched to the open state, a sheet does not experience any drive action from transportation roller 11 turning in the opposing direction and driven centrally. This enables a sheet to use the space behind the clamping arrangement for turning, while enabling the other centrally driven clamping arrangements to remain actuated in order to feed the sheet, in reversed orientation, back to the printing process (arrow II) or to an output or post-processing station (arrow III).

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A sheet transportation device comprising:

a transportation roller mounted on a driven rotation shaft said driven rotation shaft being driven during operation;

a freely rotatably arranged roller mounted on said driven rotation shaft, and being positioned in the vicinity of and fixed concentrically relative to the transportation roller, said freely rotatably arranged roller extending in a radial direction beyond a circumferential edge of the transportation roller;

a guiding element; and an actuation mechanism, said actuation mechanism switchably affecting an interspacing between the transportation roller and the guiding element, wherein, in a closed state during operation, a sheet is guided against the transportation roller by the guiding element.

2. The sheet transportation device according to claim 1, wherein the transportation roller is enclosed, in the axial direction, by the freely rotatably arranged roller and a second freely rotatably arranged roller, both of the freely rotatably arranged rollers being positioned in the vicinity of the driven roller and extending in the radial direction beyond the circumferential edge of the driven roller.

3. The sheet transportation device according to claim 1, wherein the guiding element includes a freely rotatably arranged roller, and a rotation shaft of the freely rotatably arranged roller of the guiding element extends in a direction parallel to said driven rotation shaft of the transportation roller.

4. The sheet transportation device according to claim 2, wherein the guiding element includes a freely rotatably arranged roller, and a rotation shaft of the freely rotatably arranged roller of the guiding element extends in a direction parallel to said driven rotation shaft of the transportation roller.

5. The sheet transportation device according to claim 1, wherein the guiding element extends as far as the transportation roller in an axial direction.

6. The sheet transportation device according to claim 2, wherein the guiding element extends as far as the transportation roller in the axial direction.

7. The sheet transportation device according to claim 3, wherein the guiding element extends as far as the transportation roller in an axial direction.

8. The sheet transportation device according to claim 4, wherein the guiding element extends as far as the transportation roller in the axial direction.

9. The sheet transportation device according to claim 1, wherein the actuation mechanism affects the relative position of the guiding element relative to the transportation roller, and, in operation, in an open state where the relative position of the guiding element relative to the transportation roller is farther than the closed state, a sheet can be guided past the freely rotatably arranged roller in a direction opposed to a direction of transportation of the transportation roller.

10. The sheet transportation device according to claim 1, wherein the transportation roller comprises a material at a circumferential edge thereof that has a high friction ratio.

11. The sheet transportation device according to claim 10, wherein the material at the circumferential edge of the transportation roller comprises a rubber.

12. A reversing station for reversing the orientation of a sheet, comprising a sheet transportation device, said sheet transportation device comprising:

a transportation roller mounted on a driven rotation shaft, said said driven rotation shaft being driven during operation;

a freely rotatably arranged roller mounted on said driven rotation shaft and being positioned in the vicinity of and fixed concentrically relative to the transportation roller, said freely rotatably arranged roller extending in a radial direction beyond a circumferential edge of the transportation roller;

a guiding element; and an actuation mechanism, said actuation mechanism switchably affecting an interspacing between the transportation roller and the guiding element, wherein, in a closed state during operation, a sheet is guided against the transportation roller by the guiding element.

13. A printer comprising a sheet transportation device, said sheet transportation device comprising:

a transportation roller mounted on a driven rotation shaft, said driven rotation shaft being driven during operation;

a freely rotatably arranged roller mounted on said driven rotation shaft and being positioned in the vicinity of and fixed concentrically relative to the transportation roller, said freely rotatably arranged roller extending in a radial direction beyond a circumferential edge of the transportation roller;

a guiding element; and an actuation mechanism, said actuation mechanism switchably affecting an interspacing between the transportation roller and the guiding element, wherein, in a closed state during operation, a sheet is guided against the transportation roller by the guiding element.

14. The sheet transportation device according to claim 1, wherein the freely rotatably arranged roller has a larger circumference than a circumference of the transportation roller, and the circumference of freely rotatably arranged roller and the circumference of the transportation roller are concentric.

15. The reversing station according to claim 12, wherein the freely rotatably arranged roller has a larger circumference than a circumference of the transportation roller, and the circumference of freely rotatably arranged roller and the circumference of the transportation roller are concentric.

16. The printer according to claim 13, wherein the freely rotatably arranged roller has a larger circumference than a circumference of the transportation roller, and the circumference of freely rotatably arranged roller and the circumference of the transportation roller are concentric.

* * * * *